United States Patent [19]

Stokes et al.

[11] Patent Number: 4,739,918

[45] Date of Patent: Apr. 26, 1988

[54] METHOD FOR STABILIZATION OF HEADER PLATE FLANGE AND END TANK WALL

[76] Inventors: Bennie J. Stokes, 1031 W. Verdine St.; Dyrell K. Stokes, Rte. 3, Box 1354, both of Sulphur, La.

[21] Appl. No.: 11,868

[22] Filed: Feb. 6, 1987

[51] Int. Cl.[4] ..... B23K 1/20; B23K 31/02

[52] U.S. Cl. ..... 228/173.6; 228/183; 228/15.1; 29/157.3 D; 29/157.3 R; 29/727; 72/379; 72/409; 72/414; 413/4; 413/21

[58] Field of Search ..... 228/173.6, 183, 203, 228/257, 258, 15.1; 29/726, 727, 157.4, 157.3 D, 157.3 R; 72/475, 375, 379, 409, 414; 413/4, 20

[56] References Cited

U.S. PATENT DOCUMENTS

| | | | |
|---|---|---|---|
| 2,274,550 | 2/1942 | Karmazin | 228/183 |
| 3,750,248 | 8/1973 | Morris | 228/183 |
| 4,461,348 | 7/1984 | Toge et al. | 228/183 |
| 4,512,700 | 4/1985 | Santoni | 413/4 |
| 4,614,106 | 9/1986 | Forget | 72/409 |

FOREIGN PATENT DOCUMENTS

| | | | |
|---|---|---|---|
| 48532 | 4/1977 | Japan | 228/173.6 |
| 63396 | 5/1980 | Japan | 29/157.4 |
| 181761 | 11/1982 | Japan | 228/183 |

*Primary Examiner*—Nicholas P. Godici
*Assistant Examiner*—Samuel M. Heinrich
*Attorney, Agent, or Firm*—Fleit, Jacobson, Cohn & Price

[57] ABSTRACT

When the free marginal portions 42 are telescoped within the confines of the peripheral flange 36 preparatory to the soldering operation, inward pressure on the end tank 38 usually is maintained during the soldering operation. Of course, the soldering operation involves the application of heat to both the peripheral flange 36 and the peripheral side wall 40. This sometimes will cause the free marginal portion 42 of the peripheral side wall 40 to deform inwardly away from the peripheral flange 36, thus leaving excessive spacing between the free marginal portion 42 and the peripheral flange 36. In order to avoid this condition, raised dimples 44 are formed in the header plate 34 along the peripheral flange 36 and spaced slightly inward from the latter a distance equal to the thickness of the peripheral side wall 40. Thus, the free marginal portion 42 is embraced between the inner surface of the peripheral flange 36 and the dimples 44 and thus stabilized in proper contacting juxtaposition with the peripheral flange 36. This stabilization of the free marginal portion 42 of the peripheral side wall 40 is maintained throughout the heating operation and the subsequent solder melting and flowing operation in order to form a strong and durable solder connection between the free marginal portion 42 of the peripheral side wall 40 and the peripheral flange 36.

2 Claims, 2 Drawing Sheets

METHOD FOR STABILIZATION OF HEADER PLATE FLANGE AND END TANK WALL

BACKGROUND OF THE INVENTION

1. Field of the Invention

This invention relates to an apparatus for forming raised dimples in a header plate equipped with a peripheral flange and with the dimples projecting in the same direction in which the flange projects and spaced inward of the flange a distance substantially equal to the thickness of end tank side wall free edge portions to be soldered in position relative to the flange with the free edges thereof abutted against the header plate immediately inward of the flange and outward of the dimples, the dimples preventing inward deformation of the end tank side wall free edge portions as a result of heat applied thereto preparatory to the actual soldering operation.

2. Description of the Related Art

Various different forms of hand tools for performing punching, dimpling and various other metal deformation functions and including some of the general structural and operational features of the apparatus of the instant invention heretofore have been known. Examples of these prior known forms of tools are disclosed in U.S. Pat. Nos. 2,121,669, 2,315,404, 2,618,994, 3,680,351, 3,842,650, 3,866,675 and 4,331,201. However, these previously known devices do not include the combination of structural features included in the instant invention and specifically adapted to form raised dimples in a flanged header plate spaced along and closely inward of peripheral flange of the header plate.

SUMMARY OF THE INVENTION

The apparatus of the instant invention includes a pair of jaw faces movable toward and away from each other with one jaw face defining a partial spherical recess and the other jaw face including a partial spherical projection at least substantially fully seatable within the recess upon movement of the jaw faces together. The jaw faces are adapted to clampingly engage a sheet brass (or other metal) header plate therebetween closely inward of a peripheral flange carried by the header plate for forming raised dimples in the header plates spaced along and closely inward of the peripheral flange and with the spacing between the peripheral flange and the dimples being substantially equal to the thickness of free marginal portions of side walls of an end tank to be soldered to the header plate peripheral flange along the inner surfaces of the flange. The dimples locate and stabilize the free marginal edges of the side walls of the end tank telescoped into the confines of the peripheral flange of the header plate and prevent the free marginal edge portions of the tank side walls from deforming inwardly relative to the header plate flange as a result of heat being applied to the flange and tank side walls during the soldering operation.

The tool also may be used to deform the free marginal edges of an end tank to be telescoped within the groove of a header plate whose periphery is specifically shaped to define the desired groove extending about the header plate periphery in which the side walls of the tank are to be soldered. The dimples formed in the tank side wall free edge portions, in this instance, are not provided primarily to maintain the tank side walls in position against deformation during the heating process, inasmuch as the side walls are in fact stabilized by the aforementioned groove. However, the dimples are provided to afford solder flow space between the outer surfaces of the tank side wall free edge portions and the opposing groove or channel surfaces of the header tank, although a position stabilizing effect is rendered.

The main object of this invention is to provide a tool by which various different forms of soldering operations for soldering end tank side walls to a flanged header plate may be facilitated.

Another object of this invention, in accordance with the immediately preceding object, is to provide a hand tool which may be used in conjunction with different thicknesses of sheet metal.

Yet another object of this invention is to provide a tool specifically adapted to dimple a header plate at positions spaced closely inward of and along a peripheral flange carried by the header plate.

A further object of this invention, in accordance with the immediately preceding object, is to provide a tool which is operative to utilize the peripheral flange of the header plate in accurately locating the dimples to be formed by the tool relative to the header plate flange.

Still another object of this invention is to provide a method by which soldering of an end tank to a header plate may be facilitated.

A final object of this invention to be specifically enumerated herein is to provide a method and apparatus for insuring a stronger bond between a header plate and an end tank as a result of a soldering operation and which apparatus will conform to conventional forms of manufacture, be of simple construction and easy to use to as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
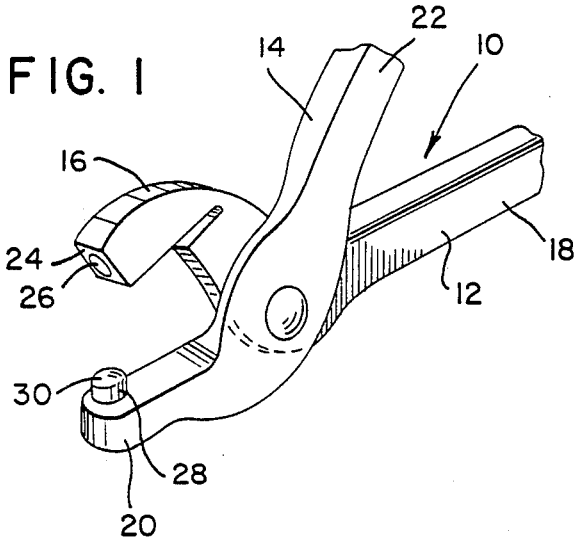
FIG. 1 is a fragmentary perspective view of a pliers-type tool constructed in accordance with the present invention.

Referring now more specifically to the drawings, the numeral 10 generally designates a tool constructed in accordance with the present invention. The tool 10 comprises a pliers-type tool including a pair of elongated crossed and pivotally connected levers 12 and 14. The lever 12 includes a jaw end 16 and a handle end 18 and the lever 14 includes a jaw end 20 and a lever end 22.

The jaw end 16 includes a substantially plane jaw face 24 and defines a partial spherical recess 26 opening outwardly through the face 24. In addition, the jaw end 20 includes a projection 28 projecting toward the jaw end 16 and including a partial spherical outer end 30.

Figure 3:
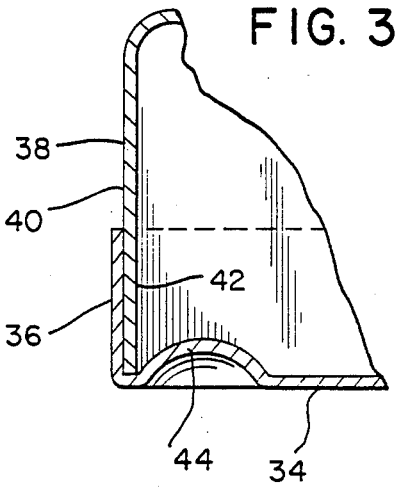
FIG. 3 is a fragmentary perspective view illustrating the manner in which the formed dimple serves to stabilize and locate the free marginal edge portion of an associated end tank side wall.
Figure 4:
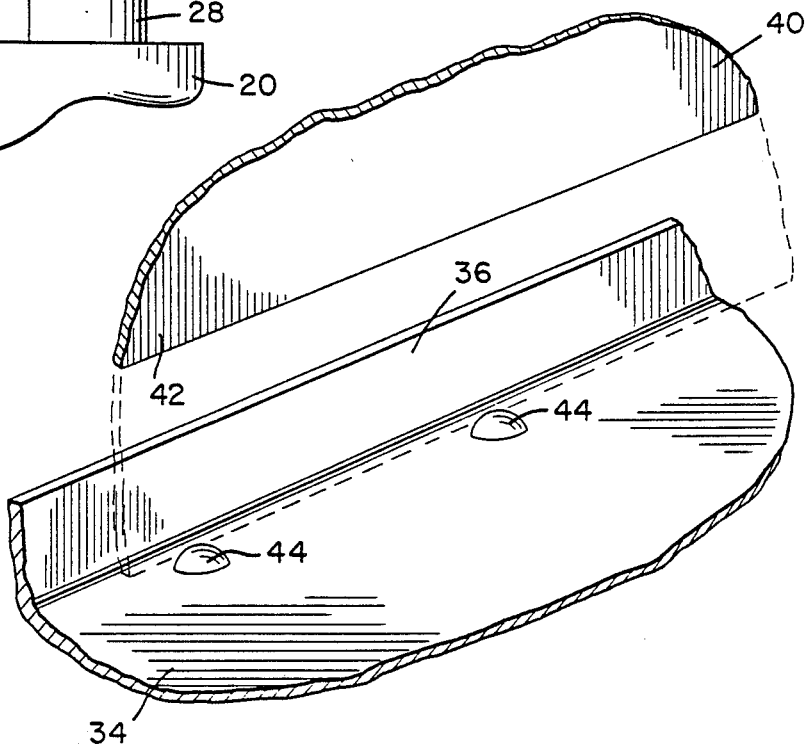
FIG. 4 is a fragmentary exploded perspective view of the header plate and end tank side wall portion with an assembled position of the tank side wall portion shown in phantom lines.
Figure 5:
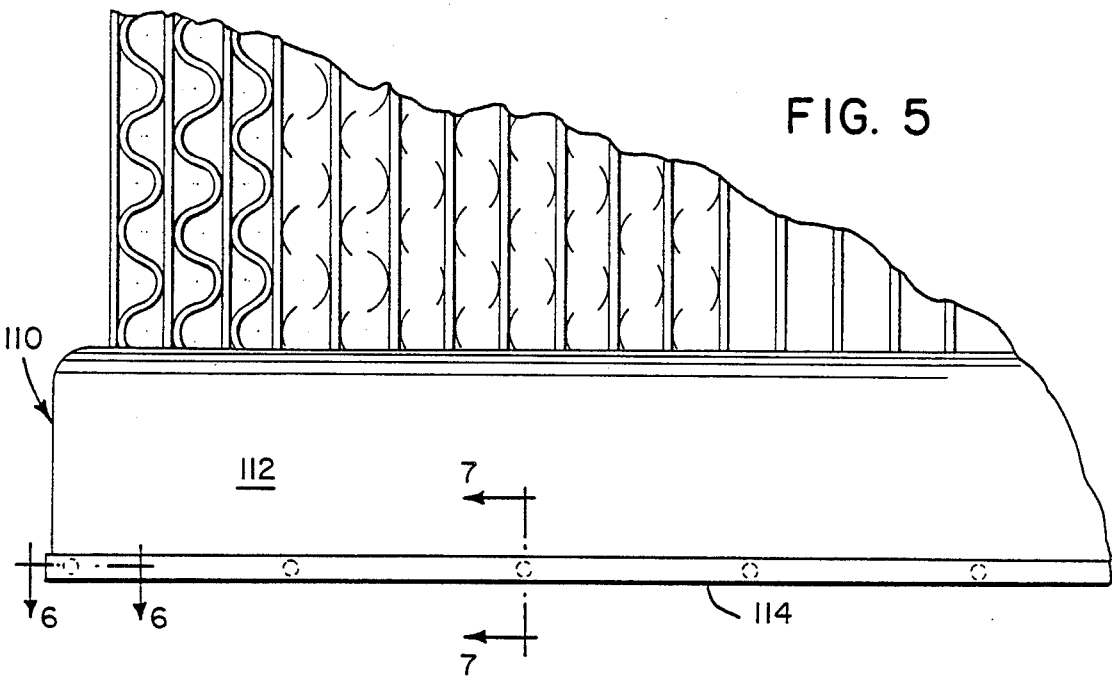
FIG. 5 is a fragmentary elevational view of a header tank and closure plate assembly wherein the free marginal edges of the side walls of the header tank have been dimpled.
Figure 6:
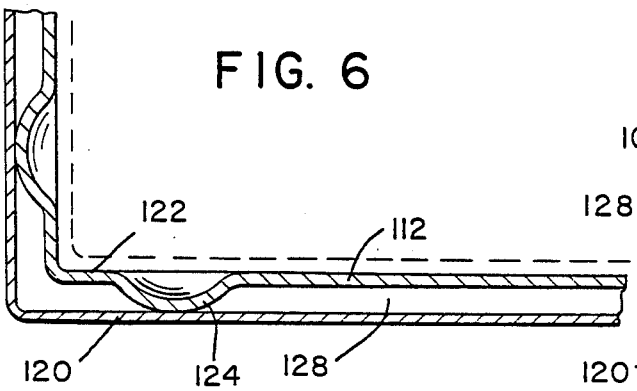
FIG. 6 is an enlarged fragmentary horizontal sectional view taken substantially upon the plane indicated by the section line 6—6 of FIG. 5.
Figure 7:
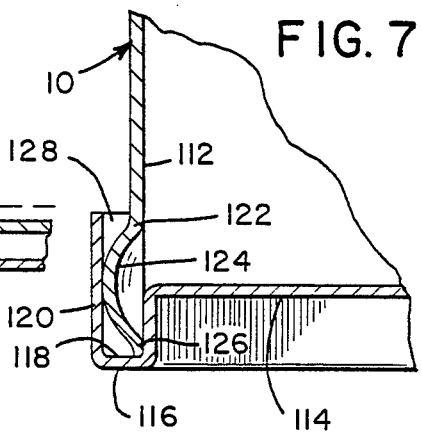
FIG. 7 is an enlarged fragmentary vertical sectional view taken substantially upon the plane indicated by the section line 7—7 of FIG. 5 and illustrating the fact that the closure plate is provided with a peripheral groove.
Figure 8:
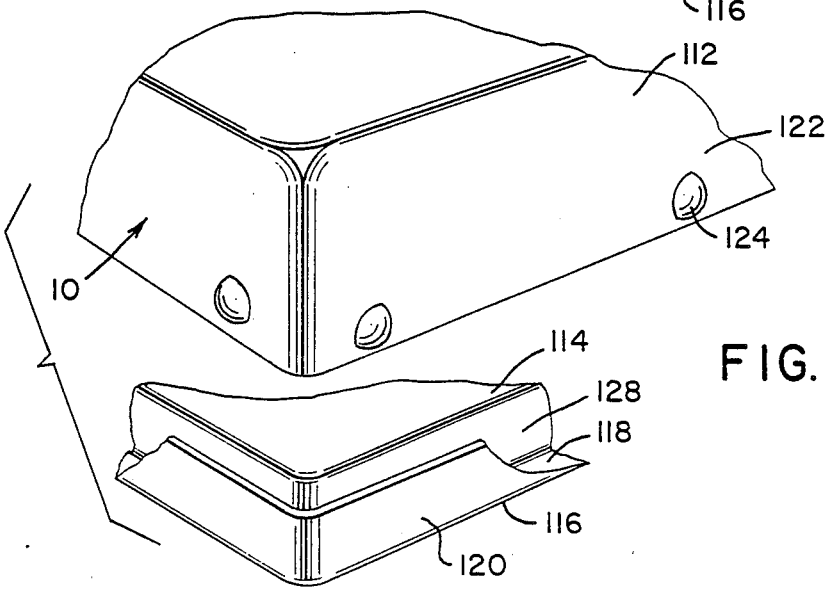
FIG. 8 is an exploded perspective view of the tank and closure plate corner portions illustrated in FIG. 5.

With reference now more specifically to FIGS. 3 and 4, a header plate is referred to by the reference numeral 34 and includes a right angled peripheral flange 36. In addition, an end tank 38 is illustrated in FIG. 3 and includes a peripheral side wall 40 including a free marginal portion 42 to be received within the confines and soldered to the inner surfaces of the peripheral flange 36.

When the free marginal portions 42 are telescoped within the confines of the peripheral flange 36 preparatory to the soldering operation, inward pressure on the end tank 38 usually is maintained during the soldering operation. Of course, the soldering operation involves the application of heat to both the peripheral flange 36 and the peripheral side wall 40. This sometimes will cause the free marginal portion 42 of the peripheral side wall 40 to deform inwardly away from the peripheral flange 36, thus leaving excessive spacing between the free marginal portion 42 and the peripheral flange 36. In order to avoid this condition, raised dimples 44 are formed in the header plate 34 along the peripheral flange 36 and spaced slightly inward from the latter a distance equal to the thickness of the peripheral side wall 40. Thus, the free marginal portion 42 is embraced between the inner surface of the peripheral flange 36 and the dimples 44 and thus stabilized in proper contacting juxtaposition with the peripheral flange 36. This stabilization of the free marginal portion 42 of the peripheral side wall 40 is maintained throughout the heating operation and the subsequent solder melting and flowing operation in order to form a strong and durable solder connection between the free marginal portion 42 of the peripheral side wall 40 and the peripheral flange 36.

Figure 2:
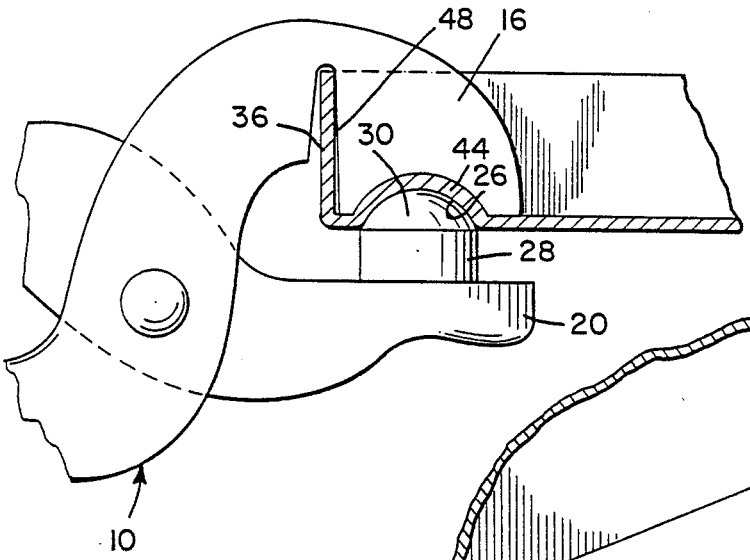
FIG. 2 is an enlarged fragmentary side elevational view of the jaw end of the tool in operation forming a raised dimple in a header plate with the dimple spaced closely inward of a peripheral flange carried by the header plate.

In order to form the dimple 44, the tool 10 is used in a manner which is believed to be obvious from FIG. 2 of the drawings with sufficient manual pressure applied to the handle ends 18 and 22 in order to deform spaced areas of the header plate 34 so as to form the dimples 44. The portions of the header plate 34 to be deformed are clamped between the outer end 30 and the recess 26 in order to form the desired dimple 44. However, in order to precisely position the dimple 44 in spaced relation to the peripheral flange 36 equal to the thickness of the free marginal portion 42 of the side wall 40, the jaw end 16 is provided with a transverse longitudinally short guide channel 48 formed therein of substantially the proper depth, according to the height of the peripheral flange 36. In this manner, with the tool 10 held at generally right angles to the peripheral flange 36, the dimples 44 formed by the tool 10 at spaced intervals along the peripheral flange 36 will be precisely spaced inward from the flange 36 a distance corresponding to the thickness of the free marginal portion of the side wall 40.

The channel 48, therefore, is extremely important inasmuch as it determines the proper spacing of the dimples 44 inward from the peripheral flange 36.

With attention now invited more specifically to FIGS. 5–8, the reference numeral 110 designates a header tank including a peripheral side wall 112 and relative to which an end plate 114 is to be soldered, the end plate including a formed periphery 116 in defining a peripheral channel 118 bounded outwardly by an outer peripheral flange 120. The channel 118 is greater in width than the side wall 112 and the free marginal edge portion 122 of the side wall 112 is provided with longitudinally spaced outwardly projecting dimples 124 corresponding to the dimples 44.

The outer extremities of the dimples 124 contact the inner surfaces of the peripheral flange 120 and thus maintain the free edge 126 of the side wall 112 against the inner surface of the channel 118 and the spacing 128 between the inner surface of the flange 120 and the non-dimpled portions of the free edge portion 122 of the side wall 112. The dimples, therefore, do serve to locate the free edge 126 against the inner surface of the channel 118 and the spacing 128 serves to allow the free flow of molten solder between the outer surfaces of the free marginal edge portion 122 and the inner surfaces of the peripheral flange 120 and upwardly between the inner surfaces of the free edge 126 and the opposing inner surface of the channel 118. This prevents failure of the ultimate soldered joint due to pressure and thermal expansion after the radiator is put into service. Of course, the dimples 124 are formed utilizing the tool 10. However, in order to properly locate the dimples 124 relative to the free edge 126, the free edge 126 is maintained in alignment with the corresponding marginal portion of the face 24 on the jaw member 26.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. The method of stabilizing the side wall free edge portions of an end tank relative to a flanged header plate closely within the flange confines of which said wall free edge portions are to be soldered, said method comprising (1) forming raised dimples in said header plate spaced along and inwardly of said flange and with said raised dimples projecting in the same direction in which the free edges of said flange face and spaced laterally inwardly from said flange a distance substantially equal to the thickness of the corresponding side wall free edge portion of said tank, (2) tightly seating said free edge portion against said header plate inwardly of the corresponding plate flange thereof and between the plate flange and the adjacent raised dimples, (3) heating said flange and side wall free edge portions to a temperature above the melting temperature of a selected solder, (4) melting said solder by direct heat transfer with said side wall free edge portion and flange and allowing the melted solder to flow between said side wall and the opposing flange inner surface and (5) thereafter allowing said solder, flange and side wall free edge portion to cool and thus said solder to solidify and effect a strong solder connection and seal between said flange inner surface and the opposing side wall free edge portion.

2. A method of insuring sufficient solder flow clearance between the inner surface of the outer flange portion of a peripherally grooved sheet metal header plate and an opposing tank side wall free edge portion to be seated in the header plate peripheral groove closely inwardly of said outer flange portion, said method comprising (1) forming a plurality of outwardly projecting dimples in said side wall free edge portion and spaced therealong with said dimples immediately adjacent the free edge of said free edge portion and the projecting extent of said dimples being equivalent to the width of said header plate peripheral groove minus the thickness of said side wall free edge portion, (2) heating said side wall portion and the grooved periphery of said sheet metal header plate to a temperature above the melting temperature of a selected solder, (3) melting solder by direct heat transfer with said heated portions of said side wall portion and header plate and allowing the melted solder to flow between said side wall free edge portion and the opposing channel surfaces of said peripheral groove, and (4) allowing said solder, side wall portion and header plate to cool and thus said solder to solidify to effect a strong solder connection and seal between said grooved sheet metal header plate and tank side wall free edge portion.

* * * * *